US009133730B2

(12) United States Patent
Joergl et al.

(10) Patent No.: US 9,133,730 B2
(45) Date of Patent: Sep. 15, 2015

(54) EXHAUST TURBOCHARGER

(75) Inventors: Volker Joergl, Breitenfurt (AT); Timm Kiener, Ludwigsburg (DE); Michael Becker, Esslingen (DE)

(73) Assignee: BorgWarner Inc., Auburn Hills, MI (US)

( * ) Notice: Subject to any disclaimer, the term of this patent is extended or adjusted under 35 U.S.C. 154(b) by 72 days.

(21) Appl. No.: 13/876,881

(22) PCT Filed: Oct. 10, 2011

(86) PCT No.: PCT/US2011/055543

§ 371 (c)(1), (2), (4) Date: Mar. 29, 2013

(87) PCT Pub. No.: WO2012/051085

PCT Pub. Date: Apr. 19, 2012

(65) Prior Publication Data

US 2013/0195620 A1 Aug. 1, 2013

(30) Foreign Application Priority Data

Oct. 11, 2010 (DE) ..... 10 2010 048 141

(51) Int. Cl.

| | |
|---|---|
| ***F02B 33/44*** | (2006.01) |
| ***F02B 37/00*** | (2006.01) |
| ***F01N 3/02*** | (2006.01) |
| ***F01N 3/04*** | (2006.01) |
| ***F02D 23/00*** | (2006.01) |
| ***F02B 33/00*** | (2006.01) |
| ***F01D 25/24*** | (2006.01) |
| ***F01N 13/10*** | (2010.01) |
| ***F02B 39/00*** | (2006.01) |
| *F02B 37/02* | (2006.01) |

(52) U.S. Cl.

CPC ..... *F01D 25/24* (2013.01); *F01N 13/105* (2013.01); *F02B 39/005* (2013.01); *F02B 37/02* (2013.01)

(58) Field of Classification Search

CPC ..... F01N 3/046; F01N 13/08; F01N 13/10; F01N 13/14; F01N 13/105

USPC ..... 60/598, 602, 605.1, 320–324; 123/559.1

See application file for complete search history.

(56) References Cited

U.S. PATENT DOCUMENTS 3,948,052 A * 4/1976 Merkle et al. ..... 60/605.1
4,179,884 A * 12/1979 Koeslin ..... 60/321
4,926,812 A 5/1990 Cailey (Continued)

FOREIGN PATENT DOCUMENTS

CN 203626940 * 6/2014
DE 102009000214 A1 9/2010

(Continued)

OTHER PUBLICATIONS

English Translation of JP 2010-84708.*

(Continued)

*Primary Examiner* — Thomas Denion
*Assistant Examiner* — Jessica Kebea
(74) *Attorney, Agent, or Firm* — BrooksGroup

(57) ABSTRACT

The invention relates to an exhaust turbocharger (1), having a turbine housing (2), which comprises an intake connection (3), the intake connection (3) being integrally connected to an exhaust manifold (4), which comprises a single exhaust gas intake (10).

9 Claims, 6 Drawing Sheets

(56) References Cited

U.S. PATENT DOCUMENTS

Figure 1A:
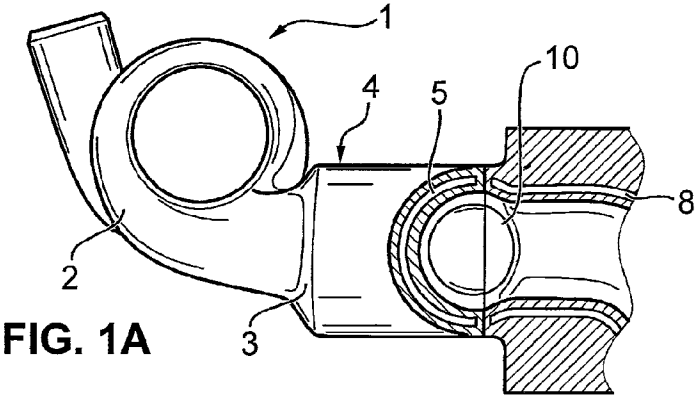

| | | | | |
|---|---|---|---|---|
| 5,109,668 | A | 5/1992 | Lindstedt | |
| 5,463,867 | A * | 11/1995 | Ruetz | 60/602 |
| 5,816,043 | A | 10/1998 | Wolf et al. | |
| 6,062,024 | A * | 5/2000 | Zander et al. | 60/597 |
| 6,256,990 | B1 * | 7/2001 | Itoh | 60/597 |
| 7,089,737 | B2 * | 8/2006 | Claus | 60/605.1 |
| 8,028,525 | B2 * | 10/2011 | An et al. | 60/612 |
| 8,051,648 | B2 * | 11/2011 | Son et al. | 60/323 |
| 8,387,243 | B2 * | 3/2013 | An et al. | 29/888.01 |
| 8,733,088 | B2 * | 5/2014 | Reinhart et al. | 60/320 |
| 2004/0083730 | A1 * | 5/2004 | Wizgall et al. | 60/614 |
| 2007/0062182 | A1 * | 3/2007 | Westerbeke, Jr. | 60/321 |
| 2010/0038901 | A1 | 2/2010 | Schmidt et al. | |
| 2010/0047054 | A1 * | 2/2010 | Dorle et al. | 415/11 |
| 2010/0180592 | A1 * | 7/2010 | Williams et al. | 60/602 |
| 2010/0296920 | A1 * | 11/2010 | Koch | 415/180 |
| 2011/0173972 | A1 * | 7/2011 | Wade et al. | 60/602 |
| 2011/0185716 | A1 * | 8/2011 | Kawamoto | 60/321 |
| 2011/0308237 | A1 * | 12/2011 | Nagayama | 60/321 |
| 2012/0198841 | A1 * | 8/2012 | Sloss | 60/605.1 |
| 2013/0014497 | A1 * | 1/2013 | Wu et al. | 60/323 |
| 2013/0186076 | A1 * | 7/2013 | Zhou et al. | 60/321 |

FOREIGN PATENT DOCUMENTS

| | | | |
|---|---|---|---|
| JP | 09324643 | A * | 12/1997 |
| JP | 2012241619 | A * | 12/2012 |
| JP | 201084708 | A * | 4/2015 |
| WO | WO 2009019153 | A2 * | 2/2009 |
| WO | WO 2010039590 | A2 * | 4/2010 |

OTHER PUBLICATIONS

International Search Report and Written Opinion ; date of mailing , May 2, 2012 ; for International Application No. PCT/US2011/055543.

* cited by examiner

EXHAUST TURBOCHARGER

The invention relates to an exhaust turbocharger. Such an exhaust turbocharger is disclosed by De 10 2009 000 214 A1. The turbine of this exhaust turbocharger is connected via an overall exhaust line to an exhaust manifold, which is incorporated in the cylinder head of an internal combustion engine, to which the exhaust turbocharger is connected.

In this design, however, problems primarily of a thermal nature occur due to the high exhaust gas flow rates, so that the thermal conduction between the hot exhaust gases and the lines carrying the gases, or rather the walls thereof, is high. If a cooled turbine housing is used, and in particular if this is composed of aluminum, this accordingly results in an increased heat return to the coolant.

The object of the present invention, therefore, is to create an exhaust turbocharger which will facilitate the provision of thermal insulation measures.

In contrast to the state of the art, according to the invention the first step for achieving the aforementioned aims is to shift the exhaust manifold to the turbine housing-side, since according to the invention the exhaust manifold is integrally connected to the intake connection of the turbine housing. This arrangement might also be defined by saying that the intake connection is embodied as an exhaust manifold, which, in contrast to known exhaust manifolds having one exhaust port per cylinder, comprises a single exhaust gas intake, which in the assembled state makes it possible to cover all exhaust ports of the cylinder head.

According to the invention it is also possible to subdivide the exhaust manifold into two areas, which are situated firstly on the turbine housing-side and secondly on the cylinder head-side. In this embodiment the exhaust ports of the respective cylinders of the internal combustion engine open out in a united port of the cylinder head, which in shape and dimension corresponds to the exhaust gas intake on the turbine housing-side, so that the exhaust manifold is virtually divided between the turbine housing and the cylinder head. This is merely an alternative, however, which makes sense particularly when thermal insulation measures are desirable or necessary also on the cylinder head-side.

According to the invention it is possible to provide the exhaust manifold of the exhaust turbocharger with a separate, closed water circuit or with an open water circuit, which in the fitted state on the cylinder head is connected to the water circuit of the cylinder head.

Furthermore, the fact that the exhaust manifold comprises a single exhaust gas intake covering all exhaust ports makes it easy to insert thermal insulations into the exhaust manifold.

In an especially preferred embodiment such a thermal insulation comprises two shells, which can be inserted into the exhaust manifold and its exhaust gas intake and which in the finally assembled state insulate the entire intake area of the turbine housing.

The aforementioned designs may be used both in single-stage and multistage exhaust turbocharger arrangements.

The turbine housing with its integral exhaust manifold is preferably embodied as a cast aluminum or steel housing.

Figure 6B:
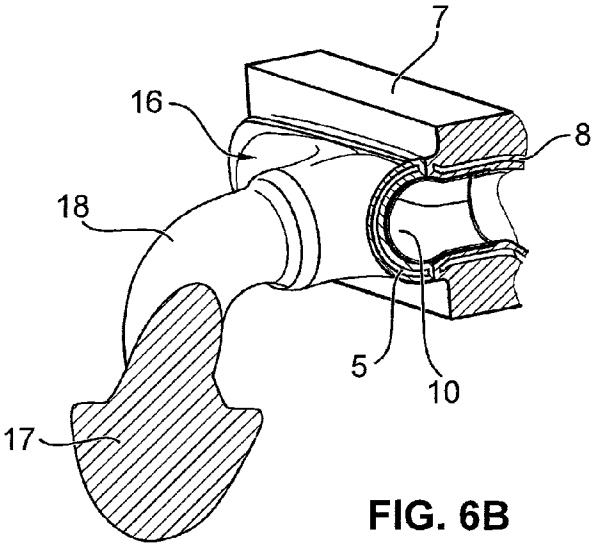
Figure 6A:
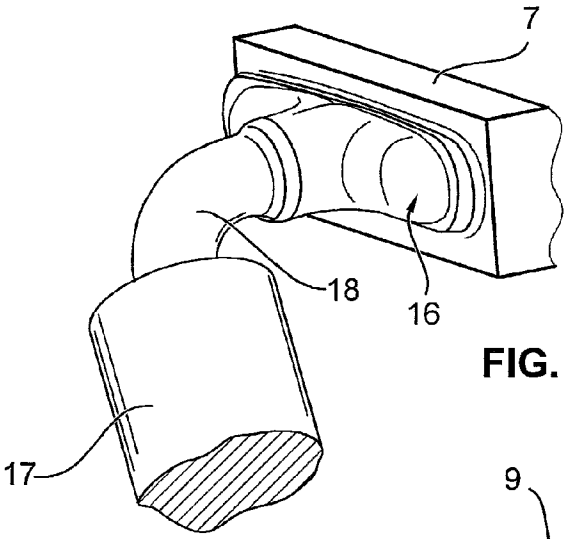
Figure 6C:
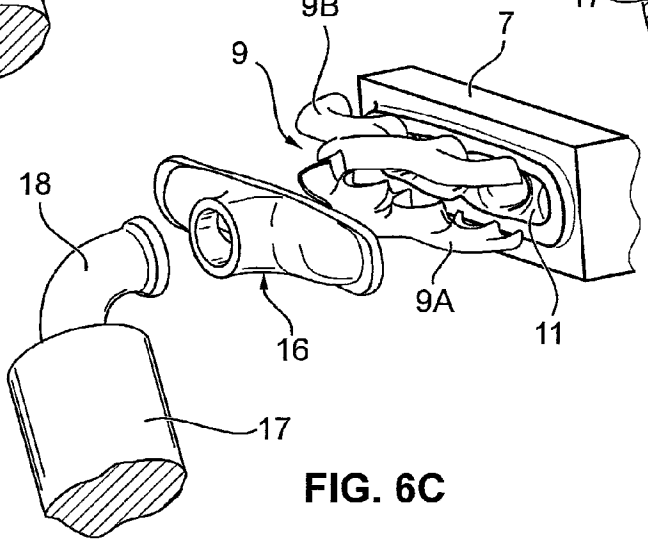

Further details, advantages and features of the present invention will be apparent from the following description of exemplary embodiments, referring to the drawing, in which:

FIGS. 1A-D show a first embodiment of the exhaust turbocharger according to the invention, FIGS. 2A-D show a second embodiment of the turbocharger according to the invention, FIGS. 3A-D show a third embodiment of the turbocharger according to the invention, FIGS. 4A-D show a fourth embodiment of the turbocharger according to the invention, FIGS. 5A-D show a fifth embodiment of the turbocharger according to the invention, and FIGS. 6A-C show representations of a manifold module with insulation and, in the case of the example, with flange-connected catalytic converter, but without exhaust turbocharger.

FIGS. 1A to 1D show an overall view of a turbocharger 1 according to the invention. The turbocharger comprises a turbine housing 2 having a turbine rotor not represented further in the figures. The exhaust turbocharger 1 naturally also comprises all the other normal components of a turbocharger, such as a compressor wheel in a compressor housing and a bearing housing for supporting a shaft connecting the compressor wheel and the turbine rotor. These components are not represented, however, since they are not necessary for explaining the invention.

The turbine housing 2 is provided with an intake connection 3, which is integrally connected to an exhaust manifold 4. As can be seen from FIGS. 1A and 1D in particular, this exhaust manifold 4 comprises a single exhaust gas intake 10, which unites the delivered exhaust gases and introduces them into the intake connection 3 and hence into the turbine housing 2. This single exhaust gas intake 10 is therefore a port, which extends over the entire width B (see FIG. 1C) of the exhaust manifold 4. Accordingly, in the assembled state on a cylinder head 7 (see also FIGS. 1A and 1B) this exhaust gas intake 10 is capable of covering all exhaust ports of the cylinder head and therefore of uniting the exhaust gases flowing out of the cylinder head and feeding them to the turbine of the turbine housing 2.

In the embodiment according to FIGS. 1A to 1D the cylinder head is provided with an exhaust gas outlet 11, which likewise constitutes a single port, which already allows the exhaust gases from the exhaust ports 12 to 15 of the internal combustion engine (not represented in further detail in the figures) to be united. As explained at the outset, this embodiment is advantageous particularly when thermal insulation measures, such as the insertion of insulating shells, for example, are to be undertaken in the cylinder head. Such uniting in the cylinder head 7 would virtually mean that the exhaust manifold is divided into two parts. As already explained at the outset, however, according to the invention this is not absolutely necessary. It is therefore also possible for the cylinder head 7 to be provided, as usual, with a number of individual exhaust ports usually equal to the number of cylinders, which ports, in the assembled state of the turbine housing, are covered by the single exhaust gas intake 10, so that in this case the exhaust gases are united exclusively on the exhaust-turbocharger side or on the side of the exhaust manifold 4 which is integrally connected to the turbine housing 2.

Figure 1B:
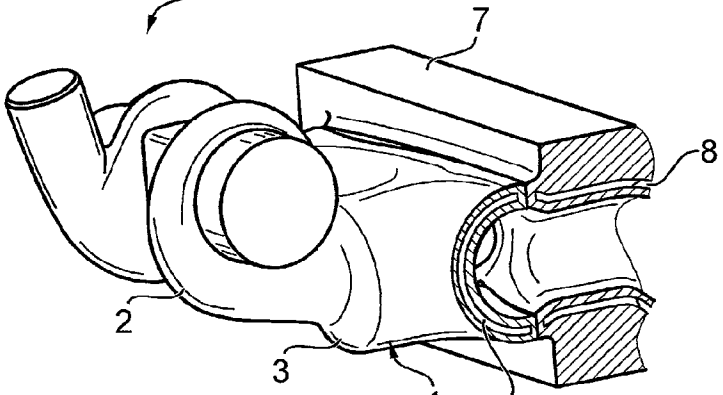
Figure 1C:
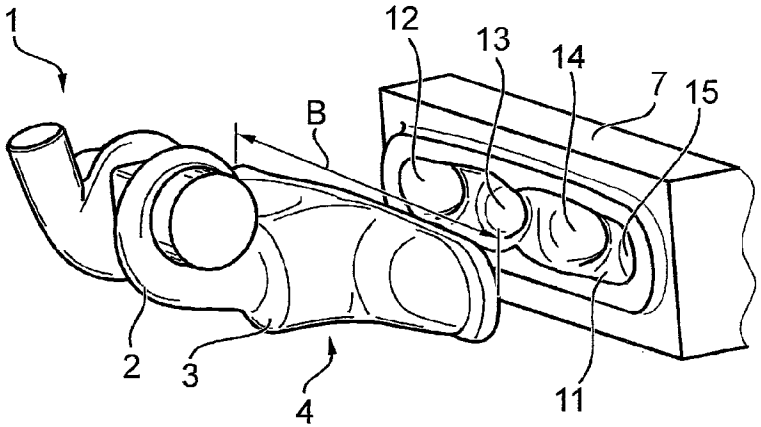
Figure 1D:
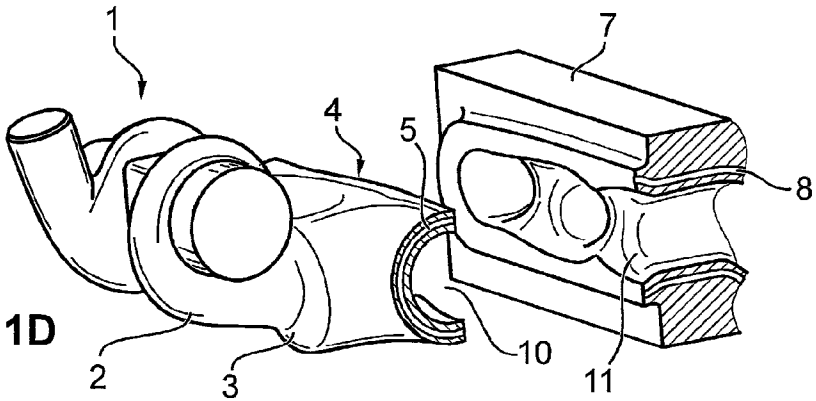
Figure 2A:
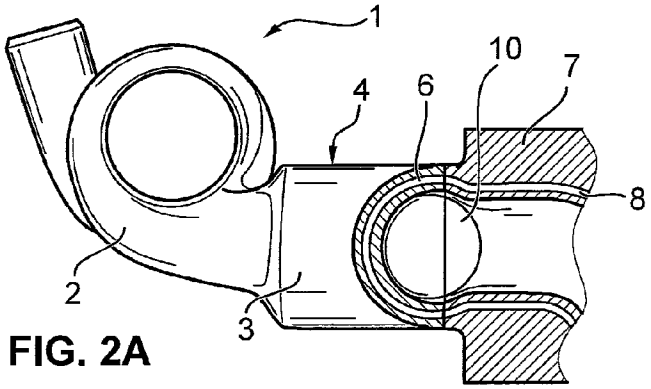
Figure 2B:
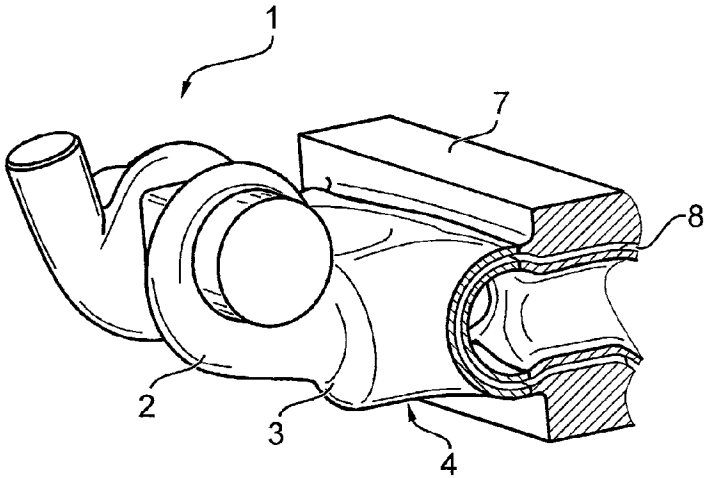
Figure 2C:
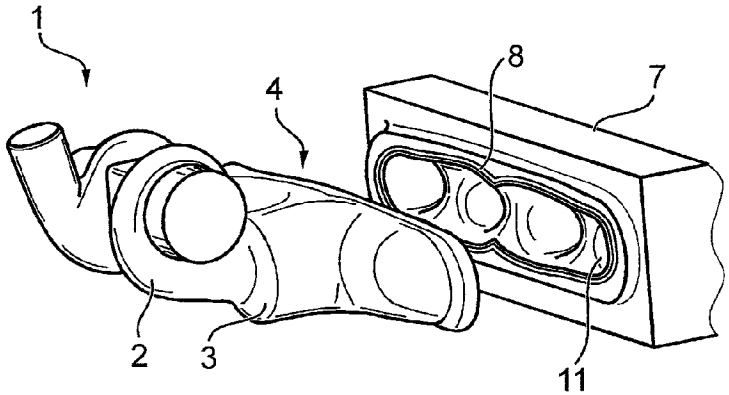
Figure 2D:
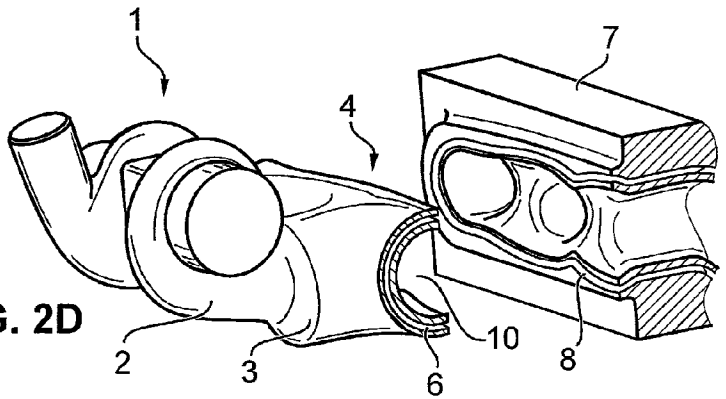

FIGS. 1A to 1D further illustrate an embodiment with FIGS. 1A and 1B showing a separate water circuit 5 in the exhaust manifold 4, which is not connected to the water circuit 8 of the cylinder head 7. This arrangement is also referred to in the technical terminology as a "closed deck" design.

FIGS. 2A to 2D represent a second embodiment of the exhaust turbocharger 1 according to the invention. All parts, which in construction and function correspond to those of the embodiments according to FIG. 1, are provided with the same reference numerals. The embodiment according to FIGS. 2A to 2D differs from the one in FIGS. 1A to 1D in that an open water circuit 6, which when in the assembled state on the cylinder head 7 is connected to the water circuit 8 of the cylinder head 7, is provided in the exhaust manifold 4, as can be seen in particular from FIGS. 2A and 2D.

FIGS. 3A to 3D represent a third embodiment of the exhaust turbocharger 1 according to the invention. Again all parts, which in construction and function correspond to the first embodiment, are provided with the same reference numerals. In the embodiment represented in FIGS. 3A to 3D, however, a thermal insulation 9 is provided, which in the example represented is constructed from two half-shells 9A and 9B. As can be seen from FIGS. 3A and 3B in particular, this heat insulation or thermal insulation 9 in the assembled state covers the entire internal surface of the exhaust gas intake 10 and the internal surface of the exhaust gas outlet 11 of the cylinder head 7, the facility for this resulting from the fact that the exhaust gas outlet 11 as well as the exhaust gas intake 10 extends as a single port over the entire width of the outlet ports 12 to 15 arranged side by side.

If the cylinder head 7 were of the usual design, that is to say provided with a plurality of individual exhaust gas outlets arranged side by side, the thermal insulation 9 could extend only in the area of the exhaust gas intake 10 of the exhaust manifold 4.

Figure 3A:
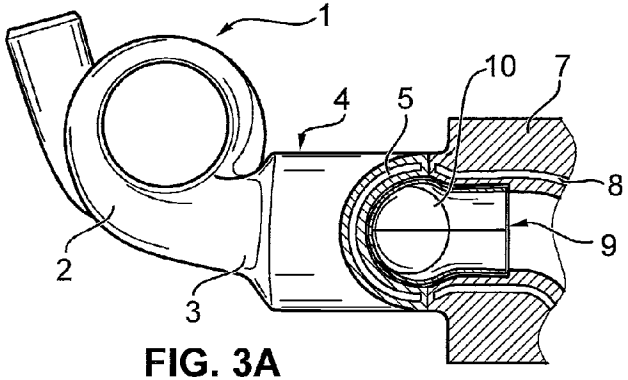
Figure 3B:
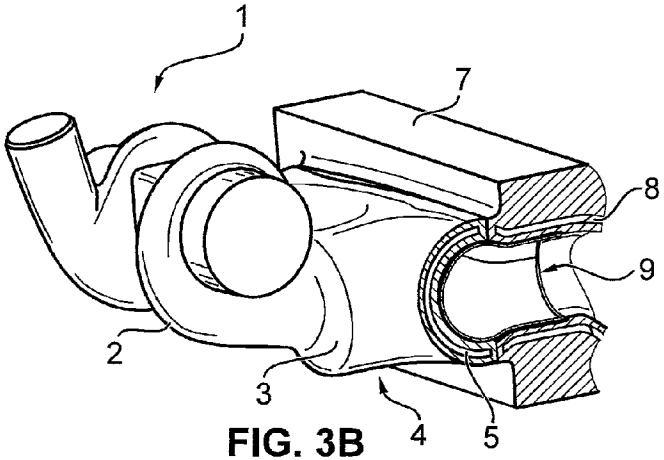
Figure 3C:
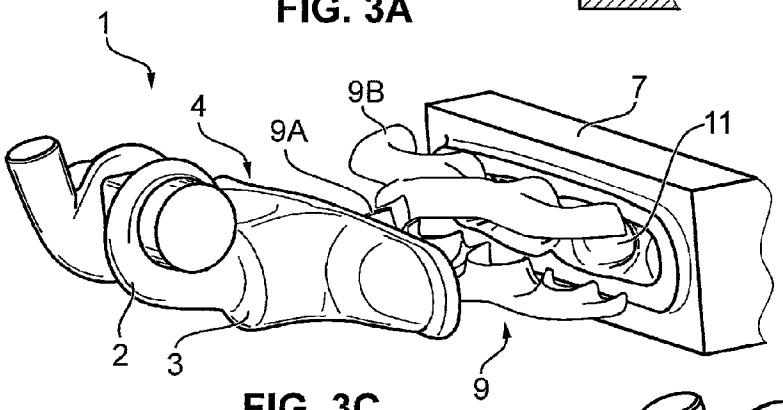
Figure 3D:
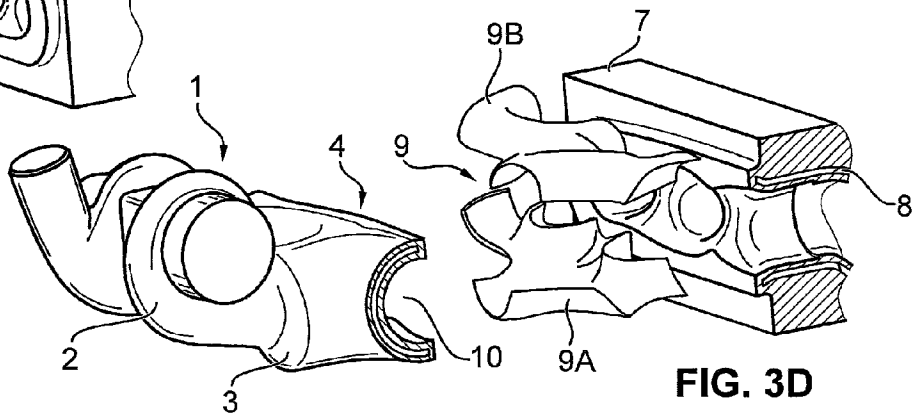
Figure 4B:
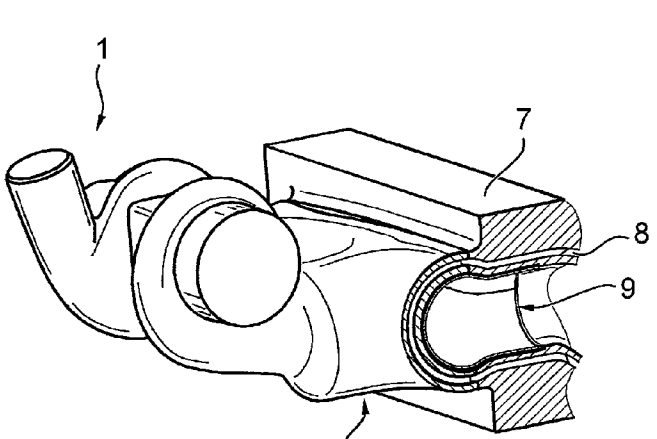
Figure 4A:
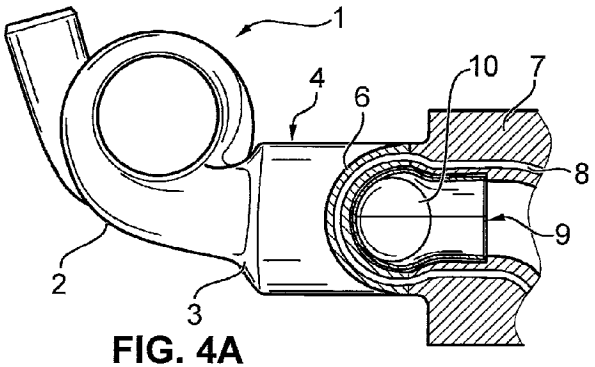
Figure 4C:
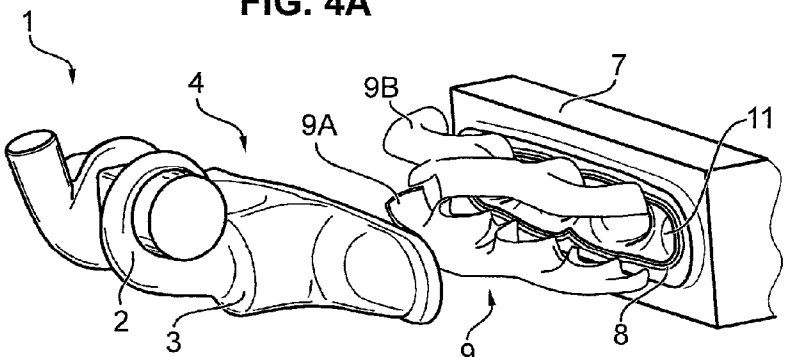
Figure 4D:
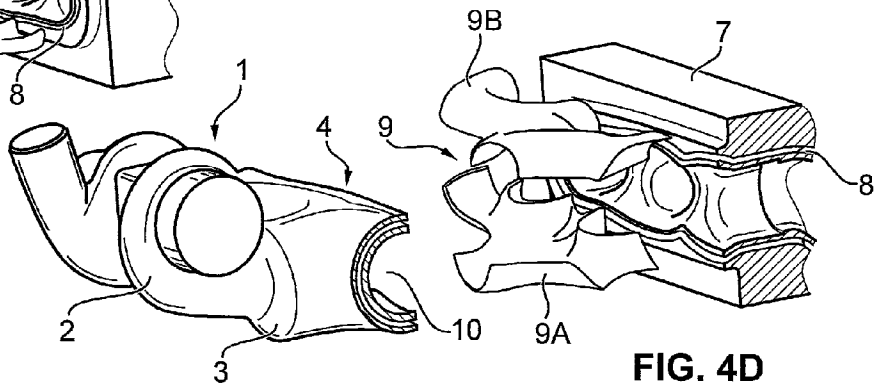
Figure 5A:
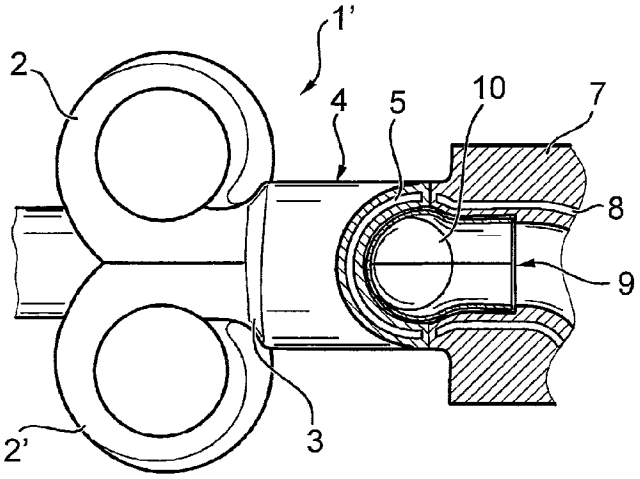
Figure 5D:
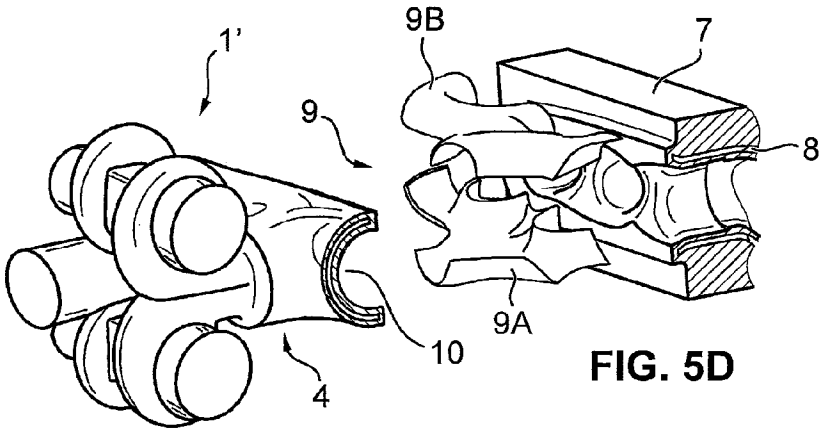
Figure 5B:
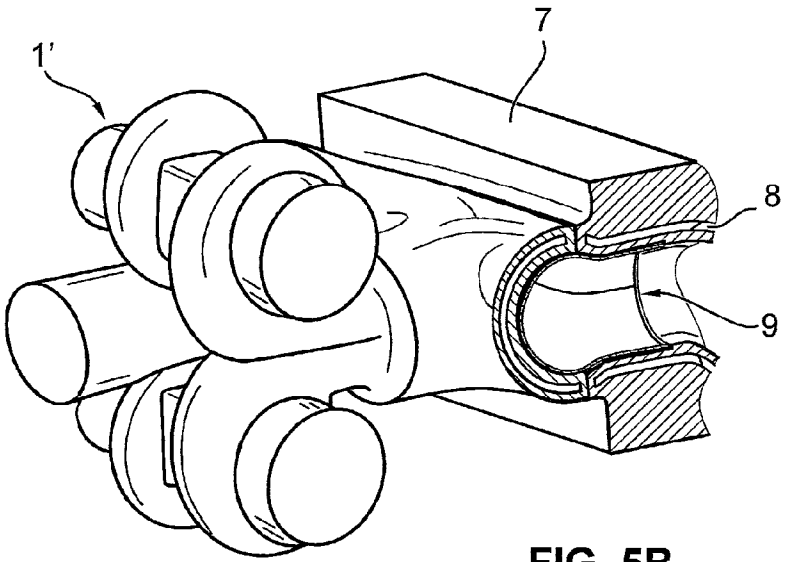
Figure 5C:
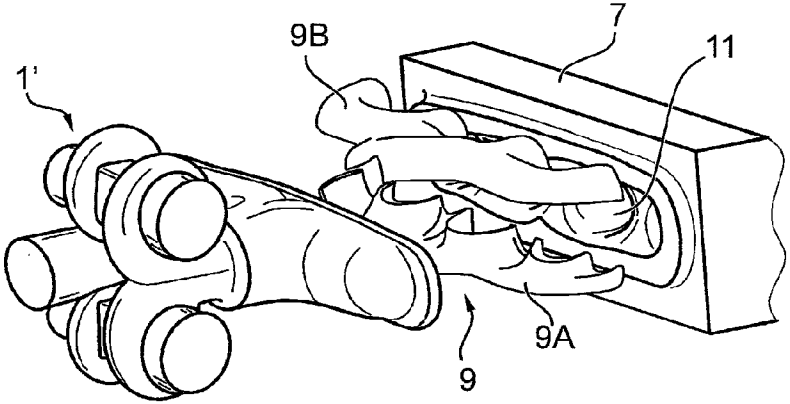

As can be seen from the representation in FIGS. 3A and 3B, the third embodiment again constitutes a so-called "closed deck" design.

In terms of the coolant ducting, the fourth embodiment according to FIGS. 4A to 4D corresponds to the one in FIGS. 2A to 2D, in which an open water circuit 6 is provided, which in the assembled state (see FIGS. 4A and 4B) is connected to the water circuit 8 of the cylinder head 7. This design is referred to as an "open deck" design. The arrangement and the construction of the thermal insulation 9 correspond to that of the third embodiment, so that with regard to this and to all other components reference may be made to the description of the preceding embodiment.

FIGS. 5A to 5D represent a fifth embodiment of the turbocharger according to the invention, in this case a two-stage turbocharger arrangement 1' having two turbines and turbine housings 2 and 2'. Otherwise the construction of this two-stage turbocharger arrangement corresponds to the one according to FIGS. 3A to 3D, so that with regard to all other components reference is made to this description in its entirety.

The invention, particularly the embodiment of the exhaust turbocharger according to the invention, in which both the exhaust gas intake 10 of the exhaust manifold 4 and the exhaust gas outlet 11 of the cylinder head 7 form a single united port for all exhaust gas outlet ports of the cylinders of the internal combustion engine, may also be defined as a turbocharger/engine arrangement, in which the exhaust manifold 4 is integrally connected to the turbine housing, but the united exhaust port is divided between the two aforementioned constituent ports in the form of the exhaust gas intake 10 and the exhaust gas outlet 11.

The embodiment according to FIGS. 5A to 5D may be provided with a high-pressure turbine bypass valve, which is not represented in FIGS. 5A to 5D, however. This high-pressure turbine bypass valve is preferably incorporated in the exhaust manifold and thereby cooled.

It should further be mentioned that the exhaust manifold half on the exhaust-turbocharger side may be provided with cooling fins. Furthermore, the exhaust manifold half on the cylinder-head side may also be provided with such cooling fins.

FIGS. 6A to 6C represent a manifold module 16, which likewise comprises one continuous exhaust gas intake port 10, which in the assembled state on the cylinder head 7 covers all exhaust gas outlet ports of the cylinder head 7.

In the embodiment represented in FIGS. 6A to 6C the cylinder head 7 comprises one continuous exhaust gas collecting port 11 for all exhaust gas outlet ports, so that again it is possible to speak of a manifold module design divided between the exhaust manifold and the cylinder head 7.

Accordingly, half-shells 9A and 9B of an insulation 9 may be inserted both into the exhaust manifold 16 and into the cylinder head 7, which can be seen in detail from FIGS. 6B and 6C. The half-shells 9A and 9B may preferably be of identical design. This embodiment of the manifold module 16 can be used when an exhaust turbocharger is not required. In this case a catalytic converter 17 may be flange-connected to the manifold module 16, for example by way of a pipe length 18.

In addition to the written disclosure of the invention, reference is hereby explicitly made to the graphic representation in the figures.

LIST OF REFERENCE NUMERALS

1, 1' exhaust turbocharger
2 turbine housing
3 intake connection
4 exhaust manifold
5, 6 water circuit
7 cylinder head
8 water circuit
9 thermal insulation
9A,B half-shells of the thermal insulation
10 exhaust gas intake
11 exhaust gas outlet of the cylinder head 7
12-15 exhaust ports of an internal combustion engine
16 exhaust manifold
17 exhaust catalytic converter
18 pipe length
B width of the exhaust gas intake 10 or of the exhaust gas outlet 11

The invention claimed is:

1. An exhaust turbocharger comprising: a cylinder head presenting an exhaust gas outlet that forms a single port in the cylinder head that is directly open to a plurality of exhaust ports; a turbine housing integrally formed with an exhaust manifold and connected to the exhaust gas outlet, an intake connection of the turbine housing integrally connected to the exhaust manifold, the intake connection comprising a single exhaust gas intake, wherein the single exhaust gas intake is formed by a depression in the cylinder head in cooperation with a depression in the exhaust manifold and extends along and covers the plurality of exhaust ports wherein the cylinder head includes a first water circuit opening that completely surrounds the exhaust gas outlet and wherein the turbine housing includes a second water circuit opening that mates with the first water circuit opening to allow cooling water to flow between the cylinder head and the turbine housing completely around the exhaust gas outlet.

2. The exhaust turbocharger as claimed in claim 1, further comprising a thermal insulation inserted into the exhaust manifold.

3. The exhaust turbocharger as claimed in claim 2, wherein the thermal insulation comprises two half-shells.

4. The exhaust turbocharger as claimed in claim 1, wherein the exhaust turbocharger is embodied as a two-stage exhaust turbocharger arrangement.

5. The exhaust turbocharger as claimed in claim 1, wherein both the turbine housing of the intake connection and of the exhaust manifold comprise aluminum or steel.

6. The exhaust turbocharger as claimed in claim 5, wherein the turbine housing comprises a cast housing.

7. The exhaust turbocharger as claimed in claim 3 wherein the thermal insulation includes extensions that extend into the cylinder head.

8. An exhaust turbocharger comprising:

a cylinder head of an internal combustion engine that includes a plurality of cylinders, the cylinder head including an exhaust port wherein the exhaust port includes a first cavity in the cylinder head that extends along the cylinder head so that exhaust ports from each of the plurality of cylinders open directly and individually into the cavity;

a turbine housing configured to house a turbine, the turbine housing being formed with an integral exhaust manifold so as to have a second cavity that extends along and mates with the first cavity in the cylinder head;

wherein the first and second cavities form a single unitary exhaust gas intake for the exhaust turbocharger, wherein the cylinder head includes a first water circuit opening that completely surrounds the first cavity and wherein the turbine housing includes a second water circuit opening that mates with the first water circuit opening to allow cooling water to flow between the cylinder head and the turbine housing completely around the exhaust port.

9. An exhaust turbocharger as claimed in claim 8 further comprising an insulating shell through which exhaust gas flows that is positioned in the exhaust manifold and extends into the cylinder head.

* * * * *